US008028860B2

(12) United States Patent
Seelhofer

(10) Patent No.: US 8,028,860 B2
(45) Date of Patent: Oct. 4, 2011

(54) HERMETICALLY SEALED LIQUID-CONTAINING BAG WITH WELDED-IN DRINKING OR DISPENSING SPOUT

(75) Inventor: Fritz Seelhofer, Lindau (CH)

(73) Assignee: Belcap Switzerland AG, Neuhausen am Rheinfall (CH)

( * ) Notice: Subject to any disclaimer, the term of this patent is extended or adjusted under 35 U.S.C. 154(b) by 602 days.

(21) Appl. No.: 12/085,478

(22) PCT Filed: Nov. 23, 2006

(86) PCT No.: PCT/CH2006/000657

§ 371 (c)(1),
(2), (4) Date: Jul. 29, 2008

(87) PCT Pub. No.: WO2007/059643

PCT Pub. Date: May 31, 2007

(65) Prior Publication Data

US 2009/0179036 A1 Jul. 16, 2009

(30) Foreign Application Priority Data

Nov. 25, 2005 (CH) ..... 1880/05

(51) Int. Cl.
*B65D 35/00* (2006.01)

(52) U.S. Cl. ..... 222/107; 222/92; 222/153.06; 222/153.07; 222/541.1; 222/541.9; 222/566; 383/38; 220/705

(58) Field of Classification Search ..... 222/92, 222/107, 211, 213, 215, 153.01, 153.06, 222/153.07, 541.9, 572, 541.1, 566, 541.6, 222/567; 383/906, 9–10, 207–210, 211, 904; 220/705, 708; 229/125.04, 103.1, 219; 215/232, 252

See application file for complete search history.

(56) References Cited

U.S. PATENT DOCUMENTS

| | | | | | |
|---|---|---|---|---|---|
| 3,342,326 | A | * | 9/1967 | Zackheim | 222/211 |
| 3,545,604 | A | * | 12/1970 | Gunther, Jr. | 206/217 |
| 4,320,789 | A | * | 3/1982 | Martin et al. | 222/107 |
| 4,553,971 | A | * | 11/1985 | Ashley et al. | 604/415 |
| 4,629,080 | A | * | 12/1986 | Carveth | 215/11.1 |
| 4,640,425 | A | * | 2/1987 | Cabernoch | 215/11.6 |
| 4,830,205 | A | * | 5/1989 | Hammond et al. | 215/11.3 |
| 5,131,553 | A | * | 7/1992 | Geasland | 220/235 |
| 5,307,955 | A | * | 5/1994 | Viegas | 222/107 |
| 5,334,180 | A | * | 8/1994 | Adolf et al. | 604/411 |
| 5,366,296 | A | * | 11/1994 | Stenstrom et al. | 383/210 |
| 5,564,591 | A | * | 10/1996 | Christine et al. | 220/705 |

(Continued)

FOREIGN PATENT DOCUMENTS

JP 08072903 A * 3/1996

(Continued)

*Primary Examiner* — Frederick C. Nicolas

(74) *Attorney, Agent, or Firm* — CUSPA Technology Law Associates; Yi Li

(57) ABSTRACT

The liquid-containing bag is produced integrally from two sheets (4; 5) which are welded to on another along the edge region (3), and the bag forms two chambers (6; 7) which are separated from one another by a separating strip (8). A drinking or dispensing spout (2) is welded with sealing action in the separating strip (8), in which case this connects the two chambers (6, 7) in the open state, the one bag chamber (6) being intended for receiving the liquid, while the other bag chamber (7), as a protective chamber, encompasses the outer spout end (9) and encloses the same with sealing action.

14 Claims, 5 Drawing Sheets

U.S. PATENT DOCUMENTS

| | | | | |
|---|---|---|---|---|
| 5,957,584 | A * | 9/1999 | Lakey | 383/5 |
| 6,126,318 | A * | 10/2000 | Bell | 383/209 |
| 6,131,806 | A * | 10/2000 | Hess et al. | 229/216 |
| 2005/0031228 | A1 * | 2/2005 | Galomb et al. | 383/96 |

FOREIGN PATENT DOCUMENTS

| | | | |
|---|---|---|---|
| JP | 10305850 | A * | 11/1998 |
| WO | WO 2004024579 | A1 * | 3/2004 |

* cited by examiner

HERMETICALLY SEALED LIQUID-CONTAINING BAG WITH WELDED-IN DRINKING OR DISPENSING SPOUT

BACKGROUND OF THE INVENTION

This invention relates to a hermetically closed fluid bag with an integrally welded drinking spout or dispensing spout. Fluid bags with all types of closures are known in many variants. The bags may be manufactured from animal skins, intestines, from rubber or also from plastic film material. Fluid bags of plastic film material are particularly practical, since they are lightweight, may assume different shapes and thus may be carried and stored much more easily, and when empty, do not take up much space, and finally because they may be disposed of without any problem. Since such fluid bags of plastic films are mostly envisaged for disposable consumption, the associated closure must be able to be manufactured in a very inexpensive manner. In medicine, such bags are also applied for preparing infusions. These bags must also provide an integrity guarantee. The solutions known until now however, are very extensive. The closures consist of several parts and are therefore expensive. The solutions for the integrity guarantee are complicated and require much effort with regard to the manufacture.

SUMMARY OF THE INVENTION

It is the object of this invention, to specify such a fluid bag with a drinking spout or dispensing spout, which is hermetically sealed, has a practical closure with a spout, and provides an integrity guarantee, wherein it should be particularly inexpensive in manufacture. Thus a drinking bag should be able to be manufactured in one variant, and in a further variant a bag for metering a fluid by way of this being sucked out of the bag.

This object is achieved by a hermetically closed fluid bag with an integrally welded drinking spout or dispensing spout, with the characterising features according to patent claims 1. The particular features are that the fluid bag forms two hermetically closed chambers, which are either separated from one another by a separating strip on a single-piece bag, or are produced by way of welding together two individual bags along a separating strip. Moreover, the drinking spout or dispensing spout is sealingly welded in the separating strip, so that in the opened condition, it connects both chambers, wherein the one bag chamber is envisaged for receiving the fluid, whilst the other bag chamber as a protective chamber encompasses and sealingly closes the outer spout end.

BRIEF DESCRIPTION OF THE DRAWINGS

Two different variants may be seen in the figures. These are described in more detail and one explains how they function and are used. In the figures.

DETAILED DESCRIPTION OF THE INVENTION

Figure 1:
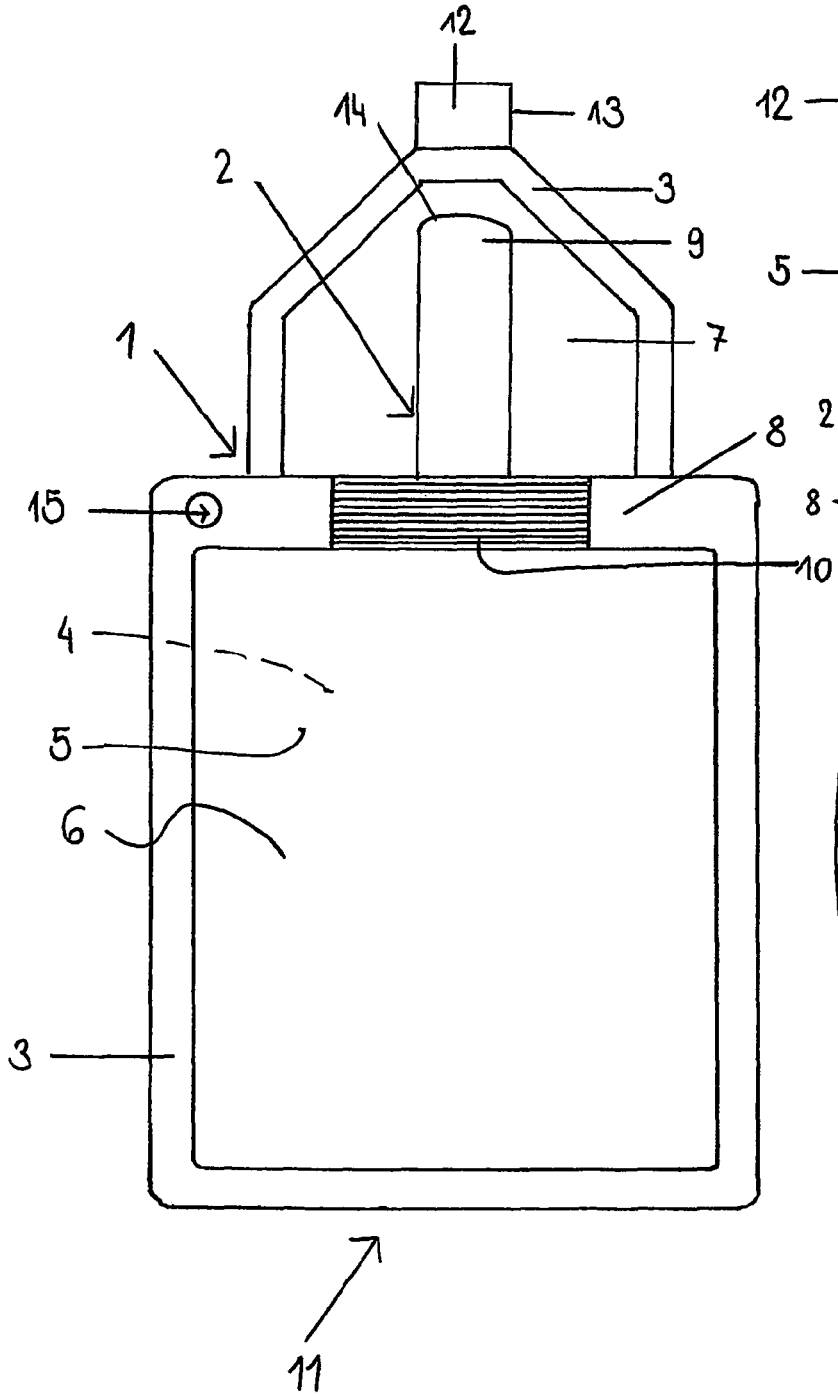
FIG. 1 shows the hermetically closed fluid bag with a drinking spout in an unopened condition, FIG. 2 the hermetically closed fluid bag with a drinking spout in an unopened condition, seen from the side, FIG. 3 the drinking spout or dispensing spout represented separately, FIG. 4 the hermetically closed fluid bag with a drinking spout in the opened condition, FIG. 5 the hermetically closed fluid bag with a dispensing spout in the unopened condition, FIG. 6 the hermetically closed fluid bag, with the dispensing spout in the opened condition, and in the position of use.

As one may see in FIG. 1, the fluid bag 1 consists of two chambers 6, 7 which are separated from one another. The bag is manufactured by way of welding two plastic films 4, 5 lying on one another, to one another along their edge 3. Simultaneously, a drinking spout or dispensing spout 2 is sealingly welded in the separating strip 8 which divides the bag into the two chambers 6, 7. The edge section 11 at the bottom on the bag chamber 6 is firstly not yet welded. The lower bag chamber 6 here is the fluid chamber. It is later filled from below, for which the bag is rotated by 180°, thus is tipped over onto the head side. It is filled in this position and afterwards the edge section 11 is welded on its lower side. The drinking spout or dispensing spout 2 itself is a plastic injection moulded part manufactured as one piece. This spout 2 consists of a base 10 and an associated pour-out spout 9. The upper bag chamber 7 completely encloses the integrally welded pour-out spout 9, and seals it hermetically to the outside. It thus forms an integrity guarantee. In order for this upper bag camber 7 to be able to be opened, it runs out to the top into two free-lying tabs 12, 13. These are simple extensions on the two film pieces 4, 5, from which the bag 7 arises by way of welding together, and since they are not welded together, they remain free and therefore may be gripped with the hands.

Figure 2:
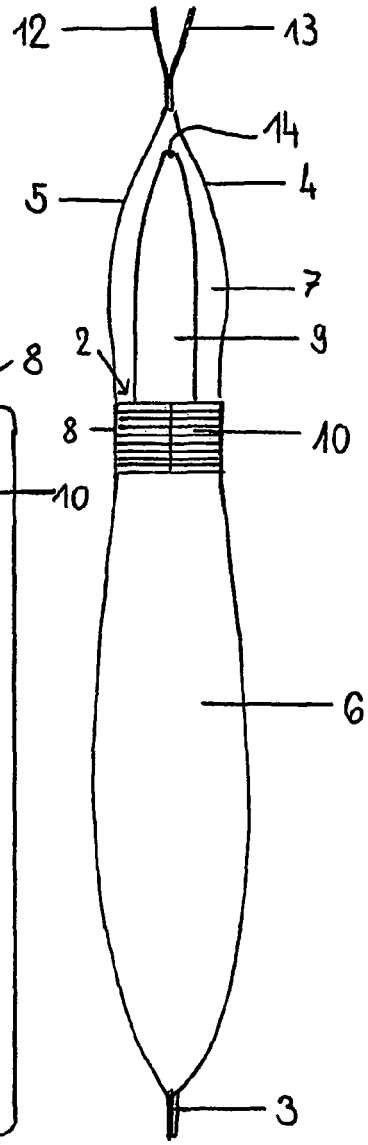

In FIG. 2, one sees the fluid bag with the two chambers 6, 7 from the side. At the bottom, one recognises the chamber 6 for the fluid, and thereabove, the chamber 7 which sealingly closed the pour-out spout 9 at a distance to it. The base 10 of the spout 2 is welded into the strip 8, which sealingly separates the two chambers 6, 7 from one another. The upper chamber 7 runs out into two tabs 12, 13, which means the two film pieces 4, 5 in each case run out into a free piece, so that these two free-lying grip tabs 12, 13 are formed. The upper bag chamber 7 provides an integrity guarantee. As long as it is undamaged, it shows that the fluid bag and its closure have not yet been opened or used.

Figure 3:
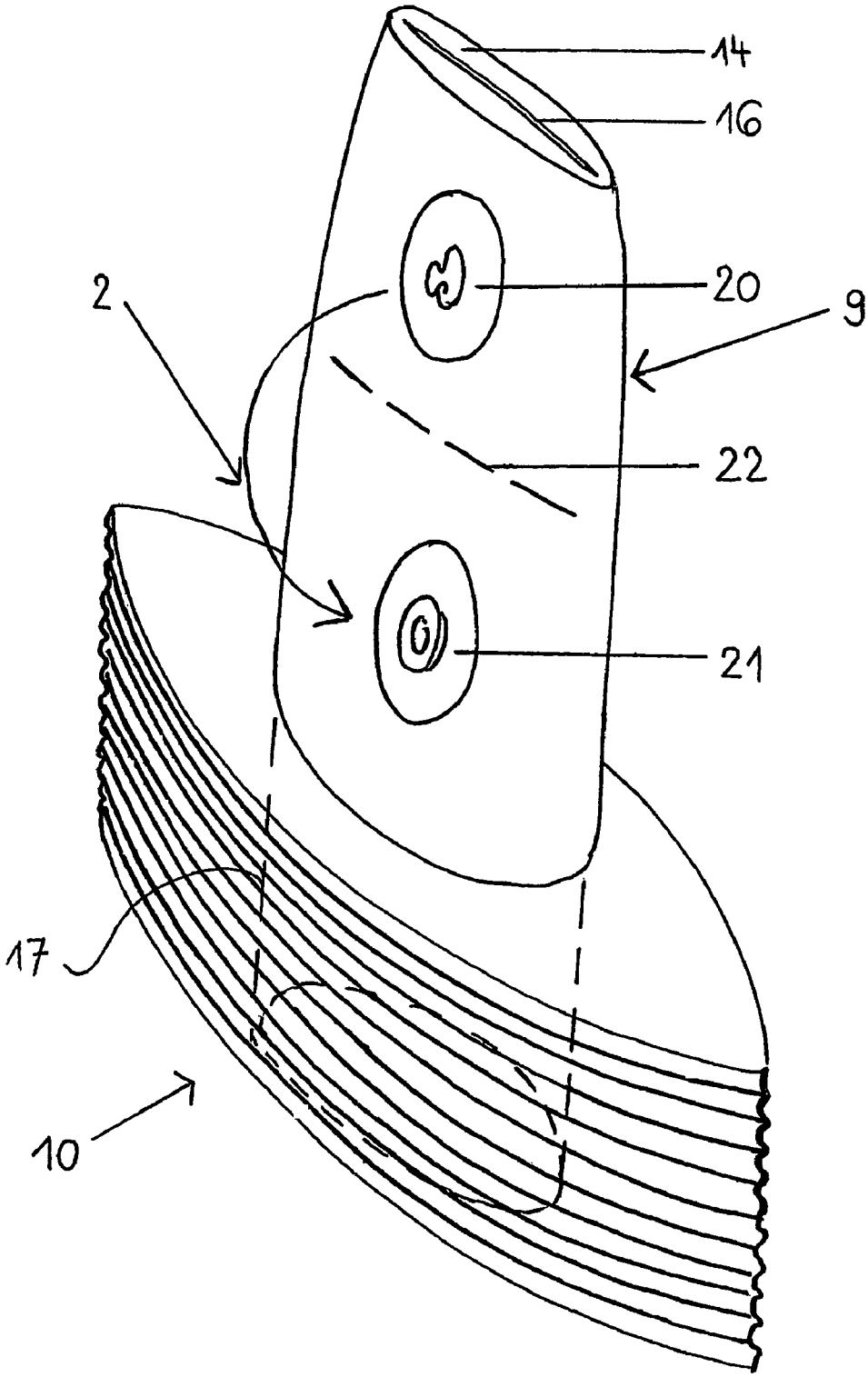

FIG. 3 shows the drinking spout and dispensing spout 2 separately. Such drinking and dispensing spouts already exist. As is evident here, such a drinking spout and dispensing spout 2 comprises a base 10. This base 10 here has the shape of a boat, wherein the lateral walls of this boat are designed in a grooved manner. With this, the boat walls may be welded to the plastic film in a particularly intimate and sealing manner. It may also be the case of an oval or round shape instead of a boat. A bore 17 passes through the boat and opens out to the outside on the lower side and upper side of the boat 10. A pour-out spout 9 is integrally formed or moulded on the upper side of the boat. This pour-out spout 9 consists of a lightweight, rubber-elastic material. The pour-out spout 9 at the end forms a lip 14 with a lip line 16. This lip line is closed by a thin location. If the pour-out spout 9 is rotated, the thin location tears and the pour-out spout 9 is accordingly opened. This rotation may be effected by way of clamping the pour-out spout between the thumb and the bent index finger, and may be rotated afterwards. Torsion forces arise by way of this, which lead to the tearing open of the thin location. On the other hand, the lip of the pour-out spout 9 may also be opened by way of leading the pour-out spout into the mouth, so that the lip 14 runs at a right angle to the mouth lip. One then bites the pour-out lip 14 together in the direction of the lip line 16, which likewise leads to a tearing-open of the thin location, and an opening of the lip 14. This pressing together of the lip in the running direction of the lip line 16 may also be effected with two fingers. The spout may optionally be provided with a push button closure 20, 21. This permits one to bend over the spout about the line 22 which is drawn dashed, and then one may close the push button 20. The spout is fluid-tight in this bent-over position. The closure ability of the spout permits firstly only part of the bag to be drunk, and the bag to be able to be further stored in a sealed manner.

Figure 4:
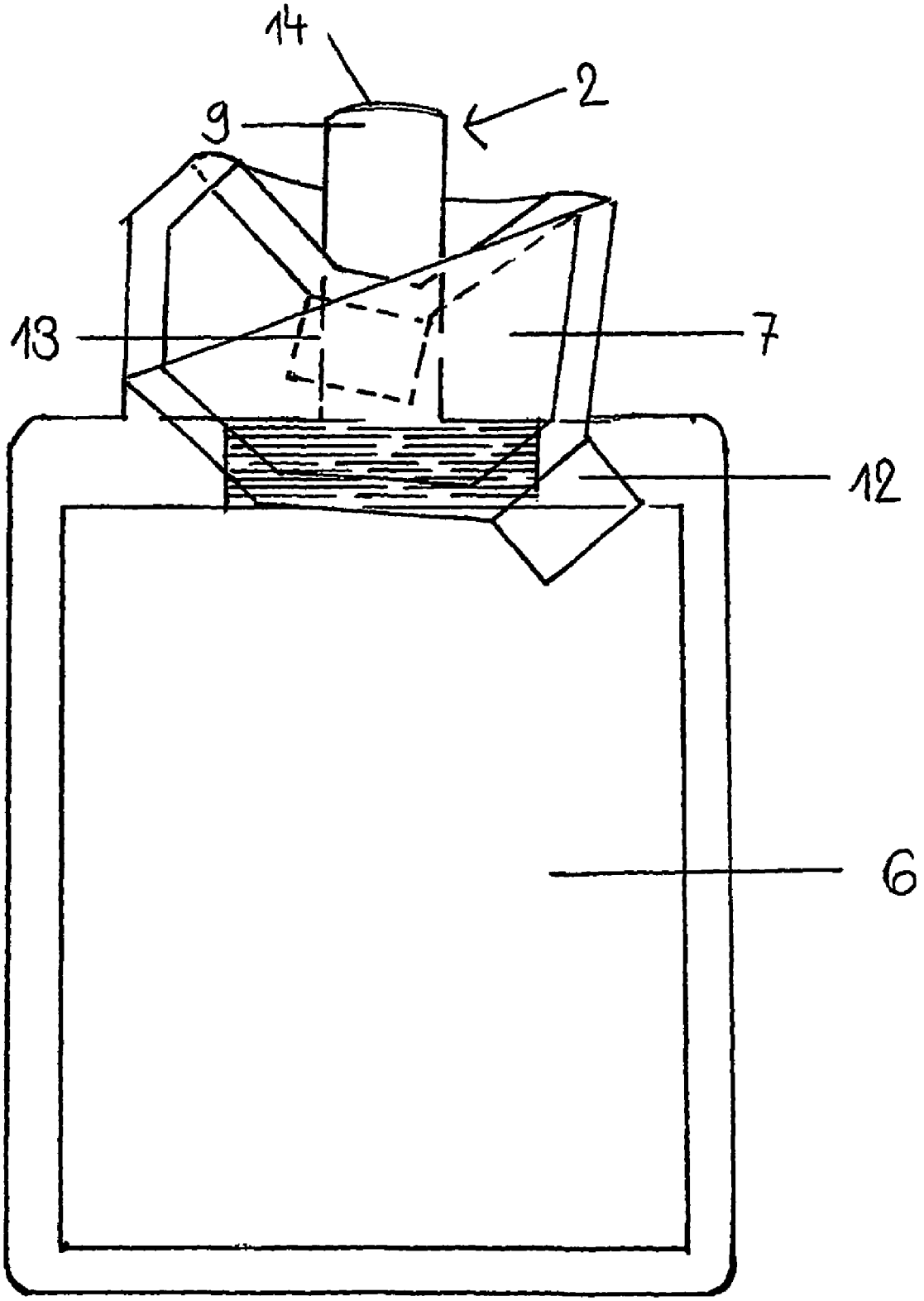

For opening such a fluid bag for the first time, one grips the two tabs 12, 13 and tears them apart, so that the welding of the upper bag chamber 7 tears. One then folds the two film parts over, as is represented in FIG. 4. The drinking spout and dispensing spout 2 is released by way of this, and the drinking spout 9 may be led into the mouth and its lip 14 may be opened. For drinking, of course the bag must lie higher than the drinking spout, unless one uses a straw which may be introduced through the opened lip 14 of the spout 9 into the fluid chamber 6 by way of pressing the two lips ends against one another, by which means the lip is opened and the drinking straw may be introduced. The lower bag 6 may also be manufactured as a standing bag in one variant, which permits the bag having been once opened, to be placed on a deposit surface.

Figure 5:
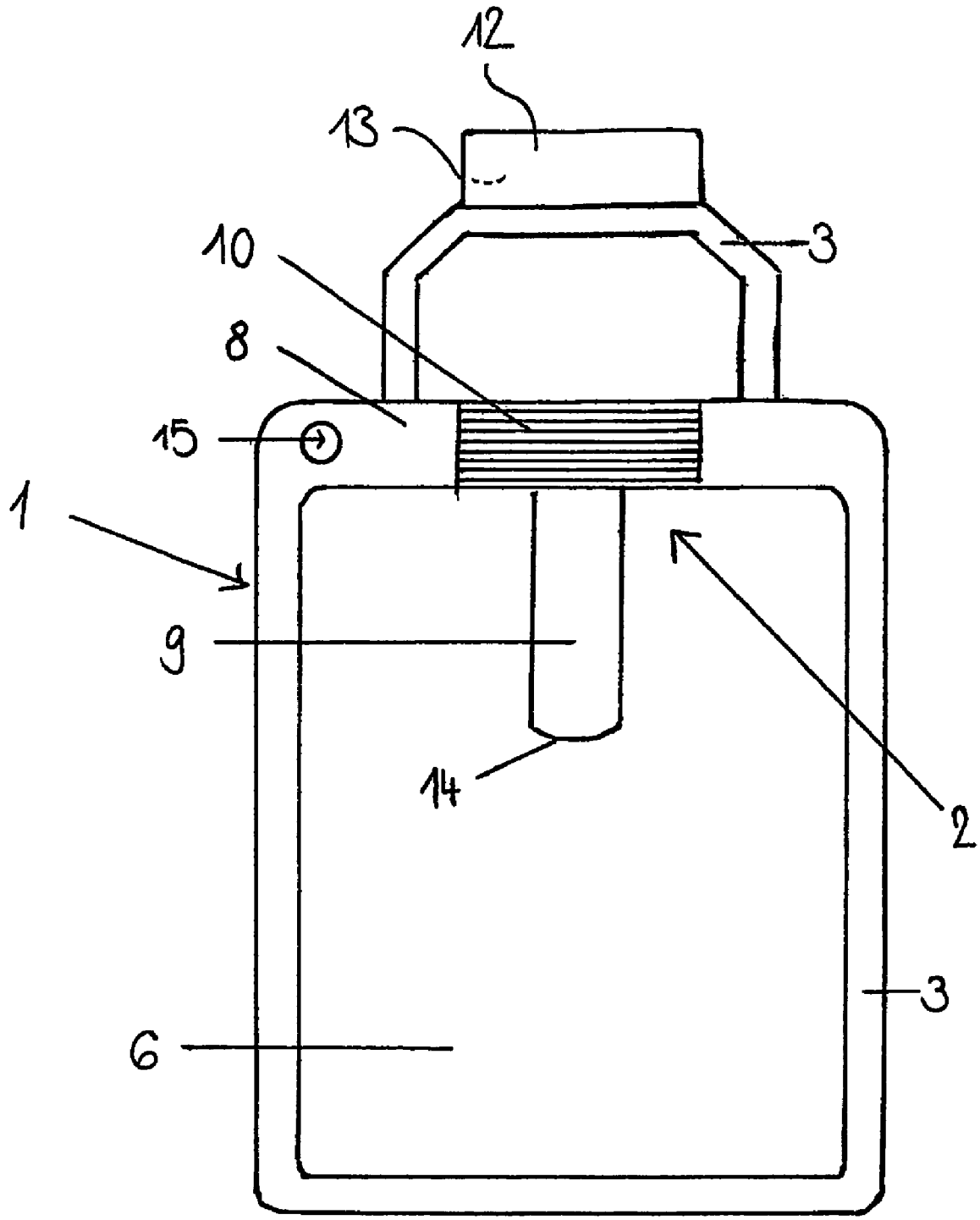

FIG. 5 shows a second variant of such a hermetically closed fluid bag. This variant is particularly conceived for medical purposes, but also for purposes where a fluid is to be removed bit by bit by way of sucking out of a bag, for example in a drinks vending machine. The only difference to the first variant presented above is that here the drinking spout and dispensing spout 2 is integrally welded, rotated by 180°. The base 10 is again welded into the strip 8, but here the spout 9 projects downwards into the bag chamber 6, which contains the fluid. This variant is also yet provided with a punch hole 15 in the edge region of the fluid bag 6, so that the bag may be hung on a hook.

Figure 6:
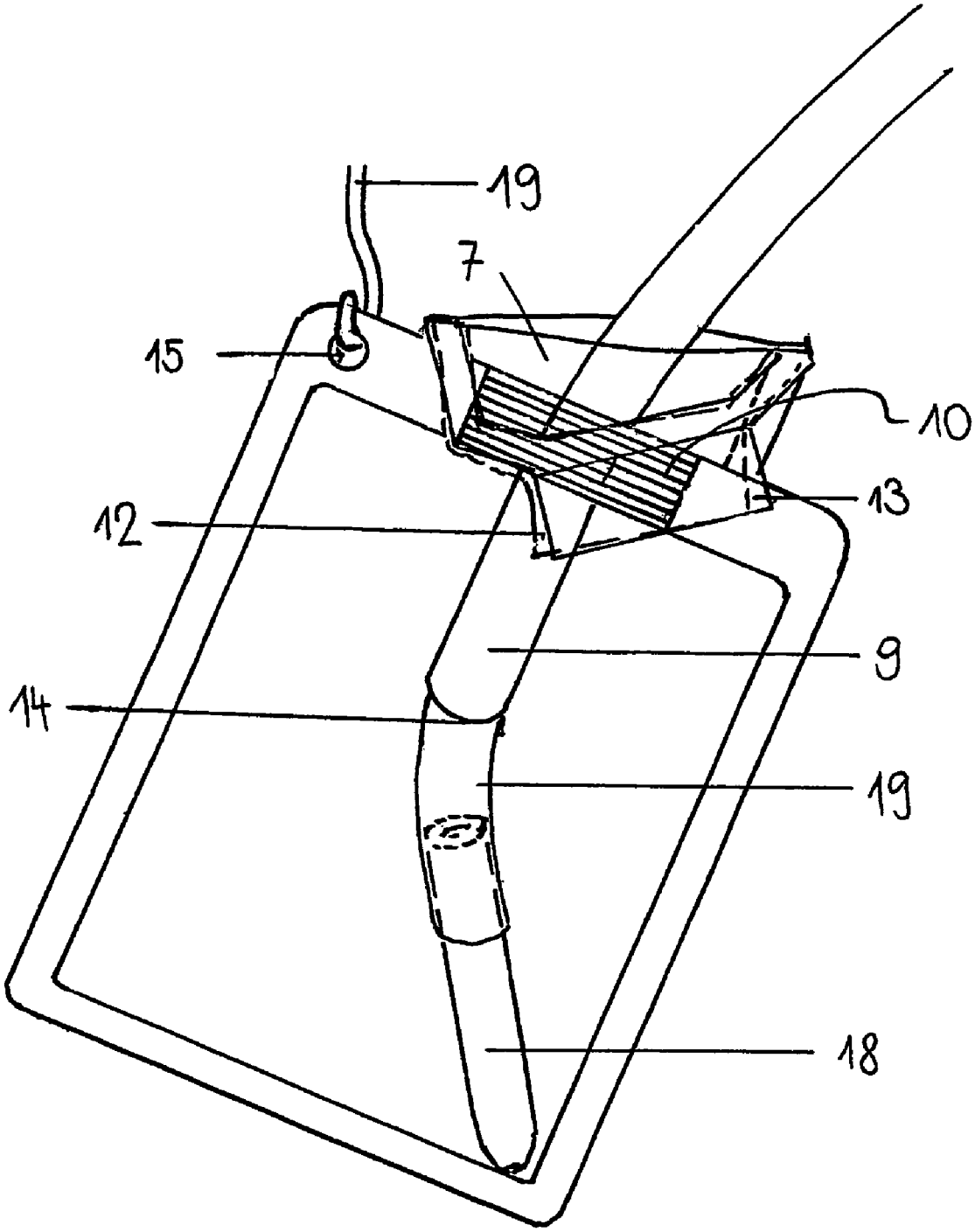

FIG. 6 shows how this variant of the fluid bag is opened and used, for medical infusions for example. Firstly, the upper bag chamber 7 is torn open as already described, by way of gripping the two free-lying tabs 12, 13 and pulling these away from one another. The welding of the upper bag chamber 7 tears by way of this. However, it is not the pour-out of the spout which is released by way of this, but merely the lower outlet of the bore through the spout base 10. A rod-like hollow tube 18 may now be introduced from above through the bore and may be pushed from the inside into the pour-out spout 9. If the tube 18 is pushed in a strong manner from the inside through the pour-out spout 9, then the lip 14 or the thin location which closes the lip, tears open. The tube 18 is pushed into the bag so far, until its end bears on the lower corner of the fluid bag. It is firmly held in this position, since the tube 18 or the flexible tube 19 which hangs on it, is peripherally clipped by the opened lip 14 of the pour-out spout 9, and holds it in a slip-resistant manner. The fluid bag is then hung with its punch hole 15 on a hook 19, so that it hangs in an oblique manner, so that a corner of the bag lies at the very bottom, as is shown in FIG. 6. Now the contents of the fluid container may be sucked out and it is ensured that the fluid bag may be completely emptied.

The invention claimed is:

1. A hermetically closed fluid bag (1) with an integrally welded-in, hermetically closed drinking spout or dispensing spout (2), whereby the fluid bag (1) forms two closed chambers (6; 7) including an upper bag chamber (7) and a lower bag chamber (6), and the two closed chambers are either separated from one another by a separating strip (8) on a single-piece bag, or are produced either by way of welding together two individual bags along the separating strip, or by producing the upper bag chamber (7) by putting over and shrinking on around the drinking spout or dispensing spout (2) which is welded into the lower bag chamber (6) and thereby said upper bag chamber (7) is welded together with said lower bag chamber (6), characterized in that the drinking spout or dispensing spout (2) in a closed condition is sealingly welded into the separating strip (8) so that the drinking spout or dispensing spout (2) connects the two chambers (6; 7) in an opened condition of the drinking spout or dispensing spout (2) and that a wedge-like lip spout (9) of the drinking spout or dispensing spout (2) either extends into the lower bag chamber (6) or into the upper bag chamber (7), and wherein the lower bag chamber (6) is envisaged for receiving a fluid, whilst the upper bag chamber (7) sealingly encloses an outlet side of the drinking spout or dispensing spout (2) as a protective chamber, and whereby said upper bag chamber (7) which works as the protective chamber is openable by hand; further that the drinking spout or dispensing spout (2) is in one piece, with a base (10) and the wedge-like lip spout (9) of rubber-elastic plastic, wherein a lip (14) at an end of the wedge-like lip spout (9) is closed hermetically via a thin location that can be torn open by mechanical action by hand or by mouth, by way of rotating the lip spout (9) or by way of pressing-together the lip (14) in a running direction of a lip line (16), or by inserting a drinking straw; and that the drinking spout (2) is provided with a push button (20, 21), so that the lip spout (9) can be bent over and secured on a bent-over position by way of the push button.

2. The hermetically closed fluid bag (1) with an integrally welded drinking spout or dispensing spout (2), according to claim 1, characterised in that the fluid bag (1) is manufactured as one piece of two films (4; 5), which are welded onto one another in an edge region (3), forming the two hermetically closed chambers (6; 7) that are separated from one another by the separating strip (8).

3. The hermetically closed fluid bag (1) with an integrally welded drinking spout or dispensing spout (2), according to claim 1, characterised in that the spout (2) is a drinking spout with the base (10) welded into the separating strip (8), and with the lip spout (9) freely projecting into the protective chamber (7), and that the protective chamber (7) consists of two films (4, 5) welded together along edges (3) thereof, wherein the two films run out at a top of the protective chamber (7) into two free-lying film tabs (12, 13) as grip tabs.

4. The hermetically closed fluid bag (1) with an integrally welded drinking spout or dispensing spout (2), according to claim 1, characterised in that the spout (2) is a dispensing spout with the base (10) welded into the separating strip (8), and with the lip spout (9) freely projecting into the lower bag chamber (6), and that the protective chamber (7) consists of two films (4, 5) welded together along edges (3) thereof, wherein the two films run out at a top of the protective chamber (7) into two free-lying film tabs (12, 13) as grip tabs.

5. The hermetically closed fluid bag (1) with an integrally welded drinking spout or dispensing spout (2), according to claim 4, characterised in that the lip (14) is closed via a thin location that can be torn open by way of pushing through a tube from an inner side of the dispensing spout (2).

6. The hermetically closed fluid bag (1) with an integrally welded drinking spout or dispensing spout (2), according to claim 1, characterised in that the base (10) of the drinking spout or dispensing spout (2) has a boat-shape, or an oval or round shape, and side walls of the base (10) comprise longitudinal grooves for an intimate and sealed welding to a transition region between the two chambers (6, 7) of the fluid bag (1), said transition region acting as the separating strip (8).

7. The hermetically closed fluid bag (1) with an integrally welded drinking spout or dispensing spout (2), according to claim 1, characterised in that the fluid bag (1) in an outer, double-ply edge region (3) comprises a punch hole (15) for hanging up the fluid bag.

8. A hermetically closed fluid bag (1) with an integrally welded-in, hermetically closed drinking spout or dispensing spout (2), whereby the fluid bag (1) forms two closed chambers (6; 7) including an upper bag chamber (7) and a lower bag chamber (6), and the two closed chambers are either separated from one another by a separating strip (8) on a single-piece bag, or are produced either by way of welding together two individual bags along the separating strip, or by producing the upper bag chamber (7) by putting over and shrinking on around the drinking spout or dispensing spout (2) which is welded into the lower bag chamber (6) and thereby said upper bag chamber (7) is welded together with said lower bag chamber (6), characterized in that the drinking spout or dispensing spout (2) in a closed condition is sealingly welded into the separating strip (8) so that the drinking spout or dispensing spout (2) connects the two chambers (6; 7) in an opened condition of the drinking spout or dispensing spout (2) and that a wedge-like lip spout (9) of the drinking spout or dispensing spout (2) either extends into the lower bag chamber (6) or into the upper bag chamber (7), and wherein the lower bag chamber (6) is envisaged for receiving a fluid, whilst the upper bag chamber (7) sealingly encloses an outlet side of the drinking spout or dispensing spout (2) as a protective chamber, and said upper bag chamber (7) is to be torn open by tearing apart grip tabs, thereby exposing the drinking spout or dispensing spout (2) in the closed condition; and wherein the drinking spout or dispensing spout (2) is in one piece having a base (10) and a wedge-like lip spout (9) of rubber-elastic plastic, the lip spout (9) at one end thereof forms a lip (14) with a lip line (16) closed hermetically by a thin location, and wherein when the lip spout (9) of the drinking spout (2) is extended into the upper bag chamber (7), after the upper bag chamber (7) is torn open, said lip spout (9) is then opened separately by rotating the lip spout (9) or by pressing-together the lip (14) in a running direction of the lip line (16), by hand or mouth, causing tearing-open of said thin location, or when the lip spout (9) of the dispensing spout (2) is extended into the lower bag chamber (6), after the upper bag chamber (7) is torn open, said lip spout (9) is then opened separately by pushing through a tube from an inner side of the dispensing spout (2) to tear open the lip line (16) closed hermetically by the thin location.

9. The hermetically closed fluid bag according to claim 8, characterized in that the fluid bag (1) is manufactured as one piece of two films (4; 5) welded onto one another in an edge region (3), forming the two hermetically closed chambers (6; 7) that are separated from one another by the separating strip (8).

10. The hermetically closed fluid bag according to claim 8, characterized in that the spout (2) is a drinking spout with the base (10) welded into the separating strip (8), and with the lip spout (9) freely projecting into the protective chamber (7), and that the protective chamber (7) consists of two films (4, 5) welded together along edges (3) thereof, and the two films run out at a top of the protective chamber (7) into two free-lying film tabs (12, 13) as the grip tabs.

11. The hermetically closed fluid bag (1) according to claim 8, characterized in that the spout (2) is a dispensing spout with the base (10) welded into the separating strip (8), and with the lip spout (9) freely projecting into the lower bag chamber (6), and that the protective chamber (7) consists of two films (4, 5) welded together along edges (3) thereof, wherein the two films run out at a top of the protective chamber (7) into two free-lying film tabs (12, 13) as the grip tabs.

12. The hermetically closed fluid bag according to claim 8, characterized in that the base (10) of the drinking spout or dispensing spout (2) has a boat-shape, or an oval or round shape, and side walls of the base (10) comprise longitudinal grooves for an intimate and sealed welding to a transition region between the two chambers (6, 7) of the fluid bag (1), said transition region acting as the separating strip (8).

13. The hermetically closed fluid bag according to claim 8, characterized in that the fluid bag (1) in an outer, double-ply edge region (3) comprises a punch hole (15) for hanging up the fluid bag.

14. The hermetically closed fluid bag according to claim 8, characterized in that the drinking spout (2) is provided with a push button (20, 21), so that the lip spout (9) can be bent over and secured on a bent-over position by way of the push button.

* * * * *